United States Patent [19]

Kuwano

[11] 4,380,164

[45] Apr. 19, 1983

[54] WINDING MACHINE

[75] Inventor: Hiroaki Kuwano, Yokohama, Japan

[73] Assignee: Ishikawajima-Harima Jukogyo Kabushiki Kaisha, Tokyo, Japan

[21] Appl. No.: 226,225

[22] Filed: Jan. 19, 1981

[51] Int. Cl.[3] ..... B21C 47/04

[52] U.S. Cl. ..... 72/21; 72/148; 242/78.1

[58] Field of Search ..... 72/28, 31, 146, 148, 72/21; 242/78.1, 78.3

[56] References Cited

U.S. PATENT DOCUMENTS 3,328,990 7/1967 Sieger et al. ..... 242/78.1 X

FOREIGN PATENT DOCUMENTS 50-40963 4/1975 Japan .
53-109844 9/1978 Japan .
55-68123 5/1980 Japan ..... 242/78.1
517351 7/1976 U.S.S.R. ..... 72/148

*Primary Examiner*—Ervin M. Combs
*Attorney, Agent, or Firm*—B. B. Olive

[57] ABSTRACT

A winding machine for winding a strip in which a plurality of wrapper rolls disposed around a mandrel are adapted to be retracted away from the mandrel whenever the stepped portion of the strip passes them in response to the control signal generated at the time when the stepped portion passes each wrapper roll, the time being calculated automatically from the time when the stepped portion passes a specified wrapper roll.

2 Claims, 4 Drawing Figures

WINDING MACHINE

BACKGROUND OF THE INVENTION

The present invention relates to a winding machine for winding a metal strip.

When the leading edge of a strip is gripped between a mandrel and a wrapper roll or when a portion of the strip overlaying the leading edge (which will be referred to as the "stepped portion" in this specification) passes past the wrapper roll after coils of the strip are wound around the mandrel, the wrapper roll is imparted with impacts so that malfunction and/or damages to the mechanical system associated with the wrapper roll and damages or surface flaws to the wrapper strip will result. In addition, the strip will not be coiled into a desired shape.

In order to overcome these problems, a prior art device as shown in FIG. 1 has been used. A strip a is pressed against a mandrel b by a wrapper roll c when an air cylinder d is energized. A damping spring g is loaded between a bearing e and an arm f of the wrapper roll c so that the spring g may absorb the impacts caused when the leading edge or the stepped portion of the strip a passes between the mandrel b and the wrapper roll c. However, the above-described damping system has not been satisfactory in practice because of spring constant of the damping spring g and stroke of the air cylinder d.

The primary object of the present invention is therefore to provide a winding machine of the type in which a hydraulic cylinder is used to press a wrapper roll against a mandrel and when the stepped portion of a strip passes between the mandrel and the wrapper roll, the wrapper roll is moved away from the mandrel so that no shock or impact will be transmitted to the wrapper roll, whereby the use of a damping spring may be eliminated.

The present invention will become more apparent from the following description of a preferred embodiment thereof taken in conjunction with the accompanying drawings.

DETAILED DESCRIPTION OF THE PREFERRED EMBODIMENT

Figure 1:
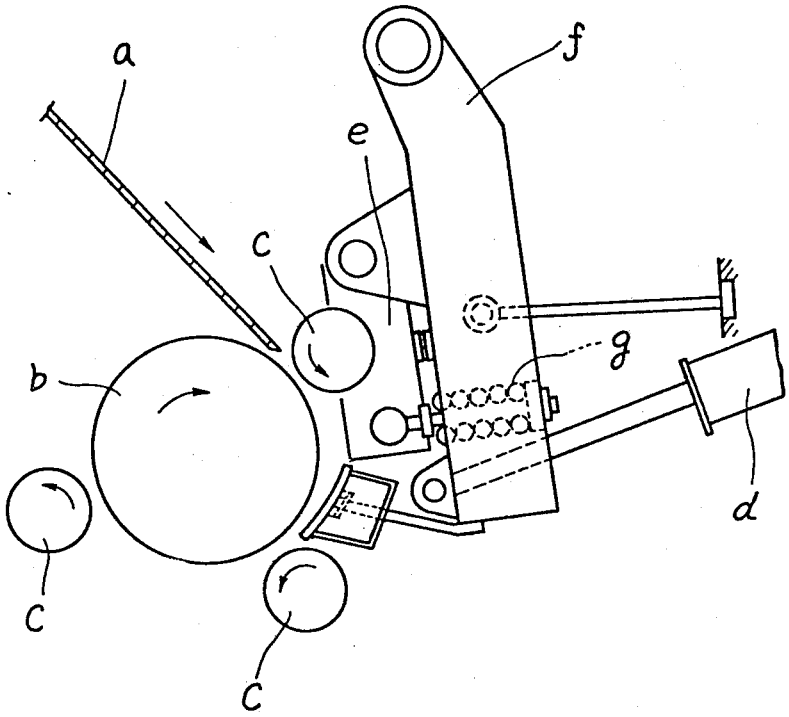
Fig. 1 PRIOR ART
FIG. 1 is a schematic side view of a prior art winding machine.
Figure 2:
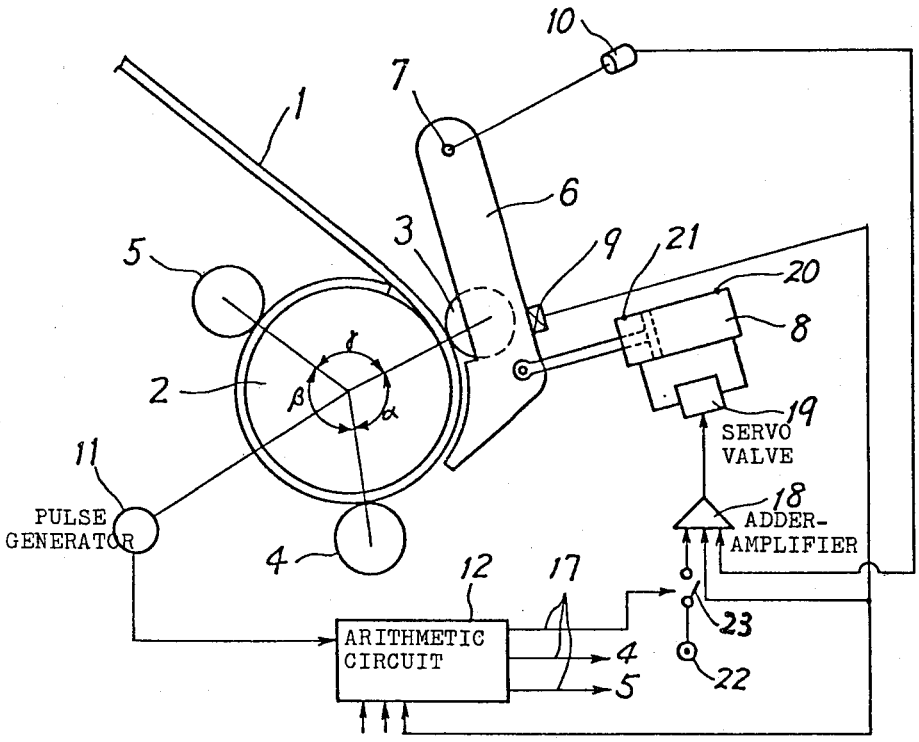
FIG. 2 is a schematic side view of a preferred embodiment of a winding machine in accordance with the present invention.

Referring first to FIG. 2, a strip 1 being wrapped around a mandrel 2 is pressed against the mandrel 2 by first, second and third wrapper rolls 3, 4 and 5. Each of the wrapper rolls 3, 4 and 5 is carried by an arm 6 which is swingable about a pivot pin 7 when the piston of a hydraulic cylinder 8 is extended or retracted. The hydraulic cylinder 8 is provided with pressure sensors 20 and 21 for sensing the pressures, respectively, before and behind the piston. An angular position sensor 10 is operatively coupled to the arm 6 so as to detect the angle of rotation of the arm about the pivot pin 7. A pulse generator 11 is operatively coupled to the shaft of the mandrel 2 so as to generate a pulse signal representative of the angle of rotation of the mandrel 2. The pulse signal is delivered to an arithmetic or control circuit 12 for determining the timing of retracting each wrapper roll away from the mandrel when the leading edge or the stepped portion of the strip 1 passes between them.

Figure 3:
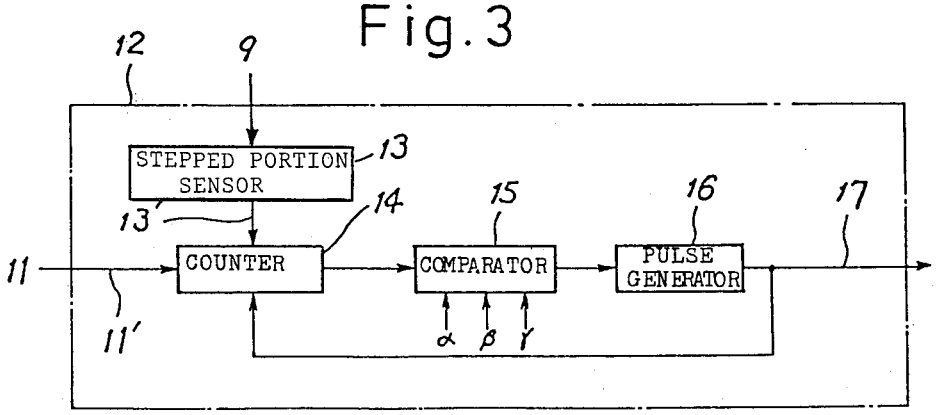
FIG. 3 is a detailed block diagram of an arithmetic circuit for determining the timing of retracting a wrapper roll as the stepped portion of a strip passes between the wrapper roll and a mandrel.

The arithmetic circuit 12 is shown in detail in FIG. 3 and comprises a stepped portion sensor 13, a counter 14 for counting the pulses transmitted from the pulse generator 11, a comparator 15 and a pulse generator 16. In response to the pulse signal from the pulse generator 11 and the output signal from an accelerometer or acceleration sensor 9, the arithmetic circuit 12 generates the control signal 17 in response to which each wrapper roll 3, 4 or 5 is retracted away from the mandrel 2.

More specifically, the control signal 17 closes a contact 23 for a timer period $\Delta T$ so that a signal 22 for setting the magnitude of displacement of the wrapper roll 3 is delivered to an adder-amplifier 18 which also receives the output signals from the accelerometer 9 and the angular position sensor 10. In response to these input signals, the adder-amplifier 18 delivers its output signal to a servo valve 19 which in turns controls the flow of the working fluid into and out of the hydraulic cylinder 8 so that the piston of the hydraulic cylinder 8 is extended or retracted.

So far only the control system for the first wrapper roll 3 has been described, but it is to be understood that the second and third wrapper rolls 4 and 5 are controlled or moved toward or away from the mandrel 2 by control systems substantially similar in construction to that described above.

In FIG. 3, the output signal from the accelerometer 9 is shown as being delivered to the stepped portion sensor 13, but it is to be understood that instead any signal representative of the movement of the wrapper roll relative to the mandrel 2 may be used. For instance, the output signal from the angular position sensor 10 or the output signals from the pressure sensors 20 and 21 may be applied to the arithmetic circuit 12, but the present invention will be described in conjunction with the output signal from the accelerometer 9.

Briefly stated, the movement toward or away from the mandrel 2 of the wrapper rolls 3, 4 and 5 is controlled as follows. First, the time when the leading edge or the stepped portion of the metal strip 1 passes between the mandrel 2 and for instance the first wrapper roll 3 is detected and based on this detected time, the time at which the leading edge or the stepped portion of the strip 1 will pass another, second or third wrapper roll 4 or 5 is calculated so that the wrapper rolls 4 and 5 may be retracted away from the mandrel 2 when the leading edge or the stepped portion of the strip 1 passes between them.

Figure 4:
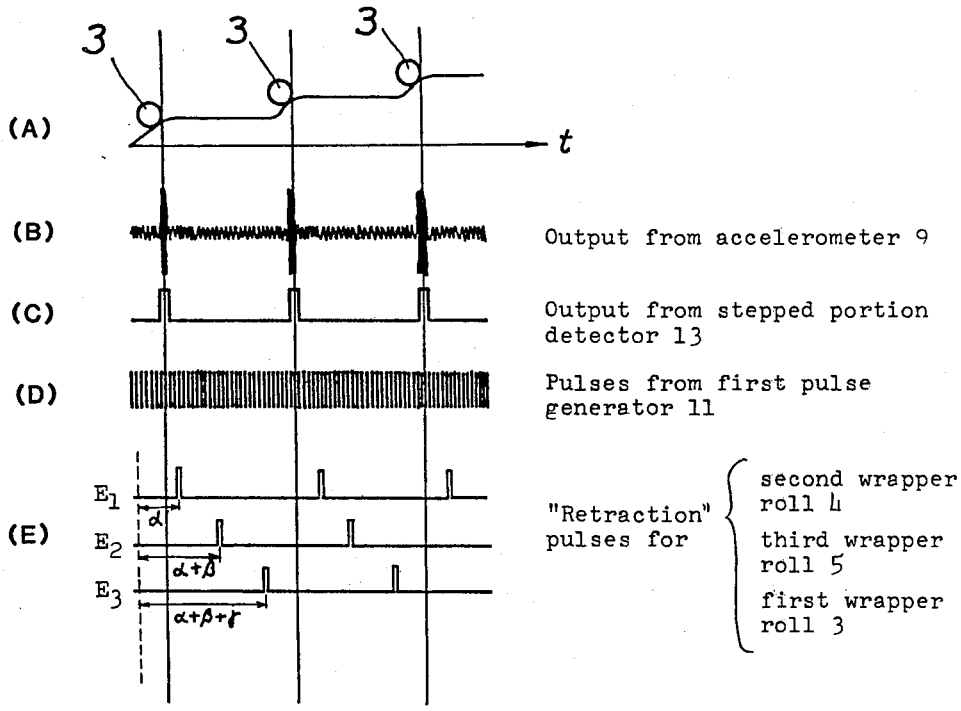
FIG. 4 shows a timing chart used for the explanation of the mode of operation of the wrapping machine shown in FIG. 2.

Referring next to FIG. 4, the mode of operation will be described in more detail below. FIG. 4(A) shows the passage of the stepped portion of the strip 1 past the first wrapping roll 3. As the leading edge or the stepped portion passes past the first wrapper roll 3, the accelerometer 9 delivers the signal as shown in FIG. 4(B) to the step portion sensor 13 which in turn generates the pulses as shown at FIG. 4(C) when the amplitude of the accelerometer output signal exceeds a predetermined level. FIG. 4(D) shows the pulses representative of the angle of rotation of the mandrel 2, the pulse spacing being equal to 360°/n, where n is an integer. These pulses are generated by the pulse generator 11. As will be described in detail below, when the arithmetic circuit 12 has counted the number of pulses D which corresponds to the angular spacing $\alpha$ between the first and second wrapper rolls 3 and 4, the circuit 12 generates the "retraction" pulse as shown at $E_1$ which represents the time when the stepped portion will pass between the mandrel 2 and the second wrapper roll 4. In like manner, when the arithmetic circuit 12 has counted the number of pulses D which corresponds to the angle $\alpha+\beta$ or the angle $\alpha+\beta+\gamma$, the "retraction" pulse as shown at $E_2$ or $E_3$ is generated for the third or first wrapper roll.

More specifically, the time when the stepped portion of the strip passes between the mandrel and the first wrapper roll 3 is referred to as the "reference time" $t_o$. At this time the accelerometer responds to the passage of the stepped portion so that the amplitude of its output signal suddenly rises as shown at (B) in FIG. 4. The output signal is delivered to the stepped portion sensor 13 which in turn generates the detected pulse as shown at (C) in FIG. 4. In response to this detected pulse, the counter 14 starts counting the pulses (FIG. 4(D)) from the pulse generator 11. When the number of pulses counted by the counter 14 coincides with the signal which has been previously applied to the comparator 15 and which represents the angle $\alpha$ between the first and second wrapper rolls 3 and 4, the comparator 15 generates the output signal which triggers the second pulse generator 16 to generate the "retraction" signal as shown at $E_1$ in FIG. 4. In like manner, when the counter 14 counts the number of pulses corresponding to the angle $\beta$ between the second and third wrapper rolls 4 and 5 (that is, the total number of pulses counted corresponds to the angle $\alpha+\beta$), the "retraction" signal for the third wrapper roll 5 is generated as shown at $E_2$. When the counter 14 further counts the number of pulses corresponding to the angle $\gamma$ between the third and first wrapper rolls 5 and 3 (that is, the total number of pulses counted corresponding to the angle $\alpha+\beta+\gamma=360°$), the second pulse generator 16 generates the "retraction" signal for the first wrapper roll 3 as shown at $E_3$. These "retraction" signals are delivered to the respective adder-amplifiers 18 of the corresponding control systems so that the second, third and first wrapper rolls 4, 5 and 3 are retracted or moved away from the mandrel 2 when the stepped portion of the strip 1 passes them in the manner described previously.

In summary, the time when the stepped portion of the strip 1 passes each of the wrapper rolls 3, 4 and 5 is detected and in response to the detected signal the hydraulic cylinder 8 in each control system is so energized as to retract the corresponding wrapper roll 3, 4 or 5 exactly at the time when the stepped portion of the strip 1 passes between this wrapper roll and the mandrel 2. Even when the number of coils of the strip 1 is increased to three or four, the time when the stepped portion of the strip 1 will pass each wrapper roll can be predicted relative to the reference time when the stepped portion passes, for instance, the first wrapper roll 3 in the manner described above so that every time when the stepped portion passes the wrapper rolls, the latter can be automatically retracted away from the mandrel 2.

So far the reference time has been described as the time when the stepped portion passes the first wrapper roll 3, but it is to be understood that the reference time may be the time when the stepped portion passes the second or third wrapper roll 4 or 5.

The effects, features and advantages of the present invention may be summarized as follows. (I) The time when the stepped portion of a strip will pass each wrapper roll can be detected or predicted relative to the reference time when the stepped portion has passed a specified wrapper roll so that each wrapper roll can be retracted away from a mandrel whenever the stepped portion passes between the wrapper roll and the mandrel. As a result, shocks or impacts to the wrapper rolls can be avoided. (II) As a result of (I), damages to the mechanical systems associated with the wrapper rolls can be avoided. In addition, damages to the strip being coiled can be avoided.

What is claimed is:

1. In a winding machine of the type in which a strip is wrapped around a mandrel so as to establish stepped portions comprising the leading edge and trailing portions of the strip overlying said leading edge, and a plurality of wrapper rolls disposed around the mandrel are forced by individually controlled hydraulic cylinders associated therewith to press the strip against the mandrel, in combination:

(a) sensor means associated with at least one of said wrapper rolls and adapted to respond to displacement of the latter with respect to the mandrel and to generate a signal representative of said displacement;

(b) a first pulse generator operatively coupled to said mandrel and adapted to generate a pulse signal representative of an angle of rotation thereof;

(c) an arithmetic circuit connected to receive the signals from said sensor means and first pulse generator and generate for each respective wrapper roll a retraction signal corresponding for each respective wrapper roll to the time the stepped portion of said strip will pass each said respective wrapper roll; and (d) means responsive to said reaction signals and operatively coupled to said hydraulic cylinders operative to cause each said hydraulic cylinder to be energized to retract the wrapper roll associated therewith away from said mandrel during the passing of the stepped portion of said strip past such associated wrapper roll.

2. In a winding machine as claimed in claim 1 wherein said arithmetic circuit comprises:

(a) a stepped portion sensor adapted to respond to the output signal from said sensor means for generating an output pulse signal representative of the passage of said stepped portion of said strip past each wrapper roll;

(b) a counter actuated by a first pulse of the output pulses from said stepped portion sensor for counting pulses from said first pulse generator;

(c) a comparator for receiving pulse numbers in terms of angles between the wrapper rolls around the mandrel and receiving the output from said counter, and for effecting comparative arithmetic;

(d) a second pulse generator for generating said retraction signal in response to an output signal from said comparator.

* * * * *